US012692577B2

(12) United States Patent
Hosch et al.

(10) Patent No.: US 12,692,577 B2
(45) Date of Patent: Jul. 28, 2026

(54) 6XXX ALUMINUM ALLOYS AND METHODS FOR PRODUCING THE SAME

(71) Applicant: ARCONIC TECHNOLOGIES LLC, Pittsburgh, PA (US)

(72) Inventors: Timothy A. Hosch, Plum, PA (US); Russell S. Long, Murrysville, PA (US); Edward M. Williams, Apollo, PA (US); Lynette M. Karabin, Ruffs Dale, PA (US)

(73) Assignee: Arconic Technologies LLC, Pittsburgh, PA (US)

( * ) Notice: Subject to any disclaimer, the term of this patent is extended or adjusted under 35 U.S.C. 154(b) by 118 days.

(21) Appl. No.: 18/102,221

(22) Filed: Jan. 27, 2023

(65) Prior Publication Data

US 2023/0175103 A1 Jun. 8, 2023

Related U.S. Application Data

(63) Continuation of application No. PCT/US2021/043898, filed on Jul. 30, 2021.
(Continued)

(51) Int. Cl.
*C22C 21/02* (2006.01)
*C22C 21/08* (2006.01)
(Continued)

(52) U.S. Cl.
CPC ..... *C22C 21/08* (2013.01); *C22C 21/02* (2013.01); *C22F 1/002* (2013.01); *C22F 1/043* (2013.01); *C22F 1/047* (2013.01); *C22F 1/05* (2013.01)

(58) Field of Classification Search
CPC ..... C22C 21/08; C22C 21/02; C22F 1/002; C22F 1/043; C22F 1/047; C22F 1/05; C21D 9/46; Y02P 10/20
See application file for complete search history.

(56) References Cited

U.S. PATENT DOCUMENTS 3,717,512 A 2/1973 Sperry et al.
4,174,232 A 11/1979 Lenz et al.
(Continued)

FOREIGN PATENT DOCUMENTS

CN 105441740 A 3/2016
CN 109338174 A 2/2019
(Continued)

OTHER PUBLICATIONS

Registration Record Series Teal Sheets, International Alloy Designations and Chemical Composition Limits for Wrought Aluminum and Wrought Aluminum Alloys, The Aluminum Association, Aug. 2018. (Year: 2018).*

(Continued)

*Primary Examiner* — Daniel J Scleis
(74) *Attorney, Agent, or Firm* — Greenberg Traurig, LLP

(57) ABSTRACT

New 6xxx aluminum alloys are disclosed. In one approach, a new 6xxx aluminum alloy may include from 0.25-0.60 wt. % Fe, 0.8-1.2 wt. % Si, 0.35-1.1 wt. % Mg, 0.05-0.8 wt. % Mn, up to 0.30 wt. % Cu, up to 0.35 wt. % Zn, up to 0.15 wt. % Ti, up to 0.15 wt. % each of Cr, Zr, and V, the balance being aluminum, incidental elements and impurities. The new 6xxx aluminum alloys may be made from recycled aluminum alloys.

17 Claims, 3 Drawing Sheets

Related U.S. Application Data

(60) Provisional application No. 63/059,559, filed on Jul. 31, 2020.

(51) Int. Cl.

| | |
|---|---|
| ***C22F 1/00*** | (2006.01) |
| ***C22F 1/043*** | (2006.01) |
| ***C22F 1/047*** | (2006.01) |
| ***C22F 1/05*** | (2006.01) |

(56) References Cited

U.S. PATENT DOCUMENTS

| | | | | |
|---|---|---|---|---|
| 4,282,044 | A | 8/1981 | Robertson et al. | |
| 4,525,326 | A | 6/1985 | Schwellinger et al. | |
| 5,223,050 | A | 6/1993 | Bryant et al. | |
| 5,525,169 | A | 6/1996 | Murtha | |
| 5,616,189 | A | 4/1997 | Jin et al. | |
| 5,843,247 | A | 12/1998 | Fukagawa et al. | |
| 5,944,923 | A | 8/1999 | Hayashi et al. | |
| 6,334,916 | B1 | 1/2002 | Matsumoto et al. | |
| 6,780,259 | B2 | 8/2004 | Bull et al. | |
| 7,364,630 | B2 | 4/2008 | Matsumoto et al. | |
| 7,824,607 | B2 | 11/2010 | Kajihara et al. | |
| 8,152,940 | B2 | 4/2012 | Nakai et al. | |
| 8,273,196 | B2 | 9/2012 | Hibino et al. | |
| 8,328,963 | B2 | 12/2012 | Takaki et al. | |
| 8,366,846 | B2 | 2/2013 | Takaki et al. | |
| 8,691,031 | B2 | 4/2014 | Zhao et al. | |
| 8,940,406 | B2 | 1/2015 | Timm et al. | |
| 8,999,079 | B2 | 4/2015 | Kamat et al. | |
| 9,085,328 | B2 | 7/2015 | Bassi et al. | |
| 9,279,173 | B2 | 3/2016 | Hori et al. | |
| 9,399,808 | B2 | 7/2016 | Matsumoto et al. | |
| 9,453,273 | B2 | 9/2016 | Matsumoto et al. | |
| 9,828,652 | B2 | 11/2017 | Kamat et al. | |
| 9,840,761 | B2 | 12/2017 | Tundal et al. | |
| 9,932,658 | B2 | 4/2018 | Shishido et al. | |
| 10,047,424 | B2 | 8/2018 | Hentschel et al. | |
| 10,112,737 | B2 | 10/2018 | Lorentzen et al. | |
| 10,533,243 | B2 * | 1/2020 | Newman | B22D 11/003 |
| 10,550,455 | B2 * | 2/2020 | Hosch | B22D 11/003 |
| 2002/0017344 | A1 * | 2/2002 | Gupta | C22F 1/05 148/698 |
| 2003/0029531 | A1 | 2/2003 | Bull et al. | |
| 2004/0079457 | A1 | 4/2004 | Kimura et al. | |
| 2004/0094249 | A1 | 5/2004 | Uchida et al. | |
| 2005/0028894 | A1 * | 2/2005 | Hoffmann | C22C 21/02 148/417 |
| 2005/0183801 | A1 * | 8/2005 | Unal | C22F 1/05 148/694 |
| 2008/0318081 | A1 | 12/2008 | Steins | |
| 2009/0148721 | A1 | 6/2009 | Hibino et al. | |
| 2010/0089503 | A1 | 4/2010 | Inagaki et al. | |
| 2012/0241055 | A1 | 9/2012 | Okamoto | |
| 2014/0130944 | A1 | 5/2014 | Kim | |
| 2014/0366998 | A1 * | 12/2014 | Kamat | B62D 29/008 148/688 |
| 2015/0354044 | A1 | 12/2015 | Shishido et al. | |
| 2016/0168677 | A1 | 6/2016 | Ribes et al. | |
| 2017/0114431 | A1 | 4/2017 | Aruga et al. | |
| 2017/0198376 | A1 | 7/2017 | Newman et al. | |
| 2017/0233853 | A1 | 8/2017 | Aruga et al. | |
| 2018/0105900 | A1 | 4/2018 | Shishido et al. | |
| 2018/0274072 | A1 | 9/2018 | Das et al. | |
| 2019/0010592 | A1 | 1/2019 | Felberbaum et al. | |
| 2019/0136342 | A1 | 5/2019 | Yan et al. | |
| 2019/0144972 | A1 | 5/2019 | Zhang et al. | |
| 2020/0024713 | A1 | 1/2020 | Das et al. | |
| 2020/0048744 | A1 | 2/2020 | Gable et al. | |

FOREIGN PATENT DOCUMENTS

| | | | |
|---|---|---|---|
| CN | 110714147 | A | 1/2020 |
| CN | 111254324 | A | 6/2020 |
| EP | 1472380 | B1 | 11/2008 |
| EP | 1633900 | B1 | 6/2009 |
| GB | 1055687 | A | 1/1967 |
| JP | H08505904 | A | 6/1996 |
| JP | H11310841 | A | 11/1999 |
| JP | 2003089859 | A | 3/2003 |
| JP | 2005-525462 | A | 8/2005 |
| JP | 2006-257475 | A | 9/2006 |
| JP | 2007262484 | A | 10/2007 |
| JP | 2012-041567 | A | 3/2012 |
| JP | 2012-214846 | A | 11/2012 |
| JP | 2017-048451 | A | 3/2017 |
| JP | 2005298882 | A * | 10/2017 |
| JP | 2017-210661 | A | 11/2017 |
| WO | 9607768 | A1 | 3/1996 |
| WO | 9814626 | A1 | 4/1998 |
| WO | 2015086116 | A1 | 6/2015 |
| WO | 2016193640 | A1 | 12/2016 |
| WO | 2018175876 | A1 | 9/2018 |

OTHER PUBLICATIONS

Rexton Steel and Alloys Website, Explore our New Aluminum 6082 Plate Prices with Global Shipping, https://www.rextonsteel.com/aluminium-6082-plates-supplier-stockist.html, Copyright 2019. (Year: 2019).*

Search Report and Written Opinion for corresponding PCT/US2021/043898; dated Nov. 8, 2021; 14 pages.

"International Alloy Designations and Chemical Composition Limits for Wrought Aluminum and Wrought Aluminum Alloys"; The Aluminum Association, Inc.; Apr. 2006; 35 pages.

"Aluminum and Aluminum Alloys—Sheet, Strip and Plate—Part 2: Mechanical Properties"; Reference No. SN EN 485-2:2016; The Standardization Committee; European Standard; Oct. 2016; 100 pages.

American Society for Metals; "Properties and Physical Metallurgy" and "Effects of Alloying Elements and Impurities on Properties" May 1984, 3 pages (pages Index and 224-225).

Third Party Observation for Application No. EP20210850887; "New 6XXX Aluminum Alloys and Methods for Producing the Same", filed Jun. 30, 2021 and Published Jun. 7, 2023; Third Party Observation dated Apr. 2, 2025 and filed Mar. 27, 2025; 6 pages.

* cited by examiner

FIG. 1 - Elong. versus TYS (T43 condition - 30 days of natural aging) (LT)
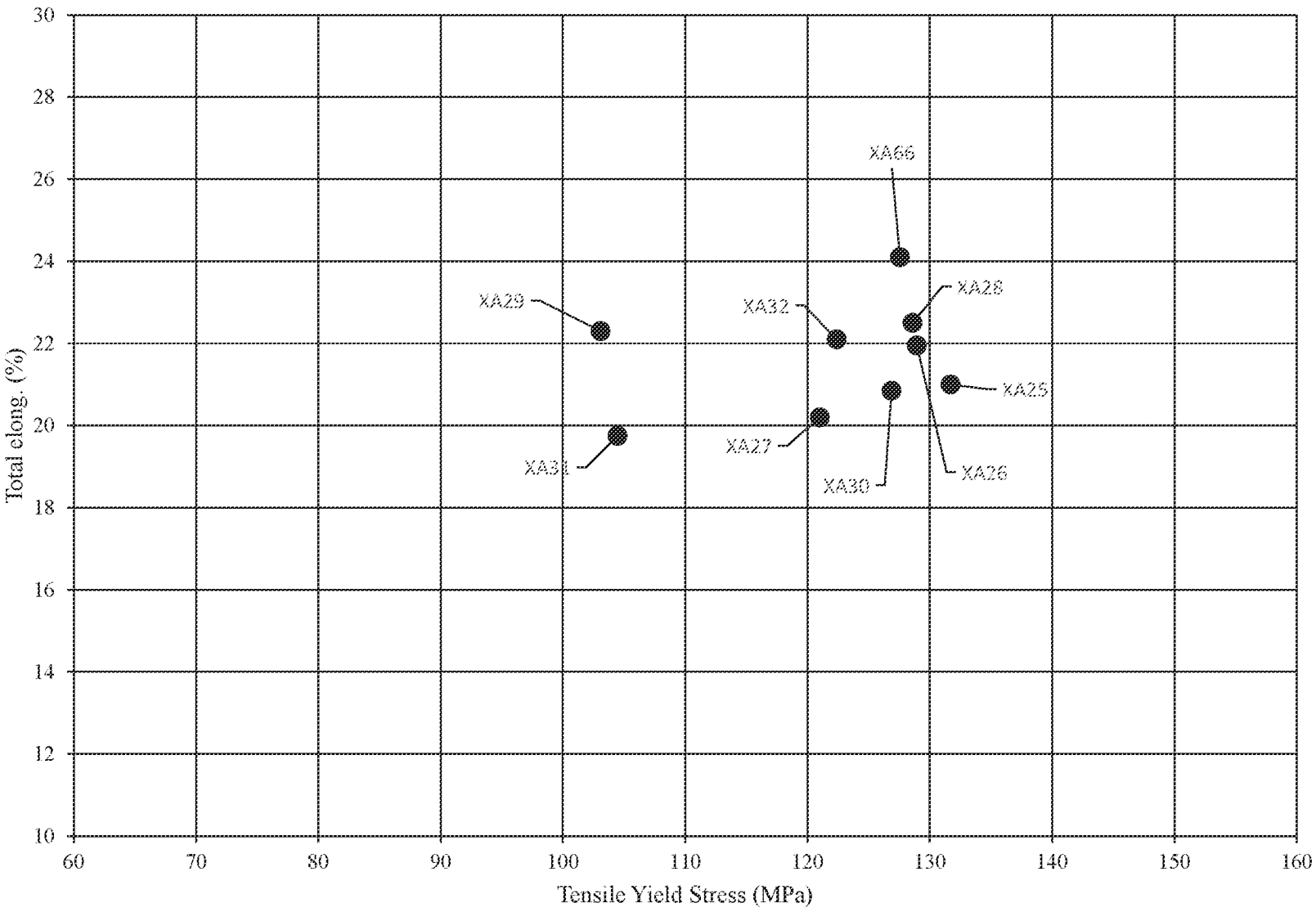

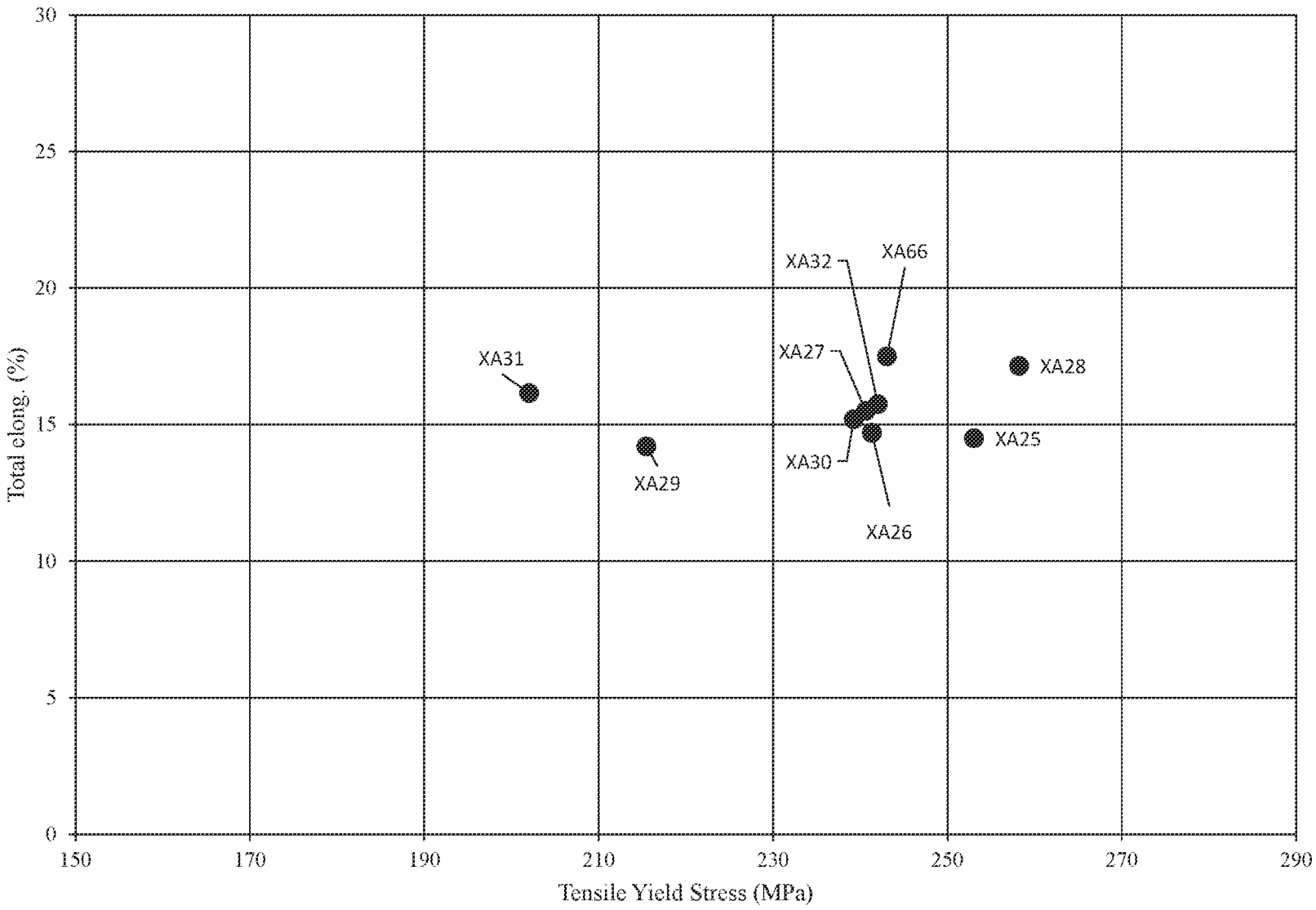
FIG. 2 - Elong. v. TYS (30 days of natural aging, 2%PS+365°F/20min) (LT)
Total elong. (%)
Tensile Yield Stress (MPa)
0
5
10
15
20
25
30
150
170
190
210
230
250
270
290
XA31
XA29
XA66
XA32
XA27
XA30
XA26
XA28
XA25

FIG. 3 - VDA Measured Bend Angle versus TYS (LT)
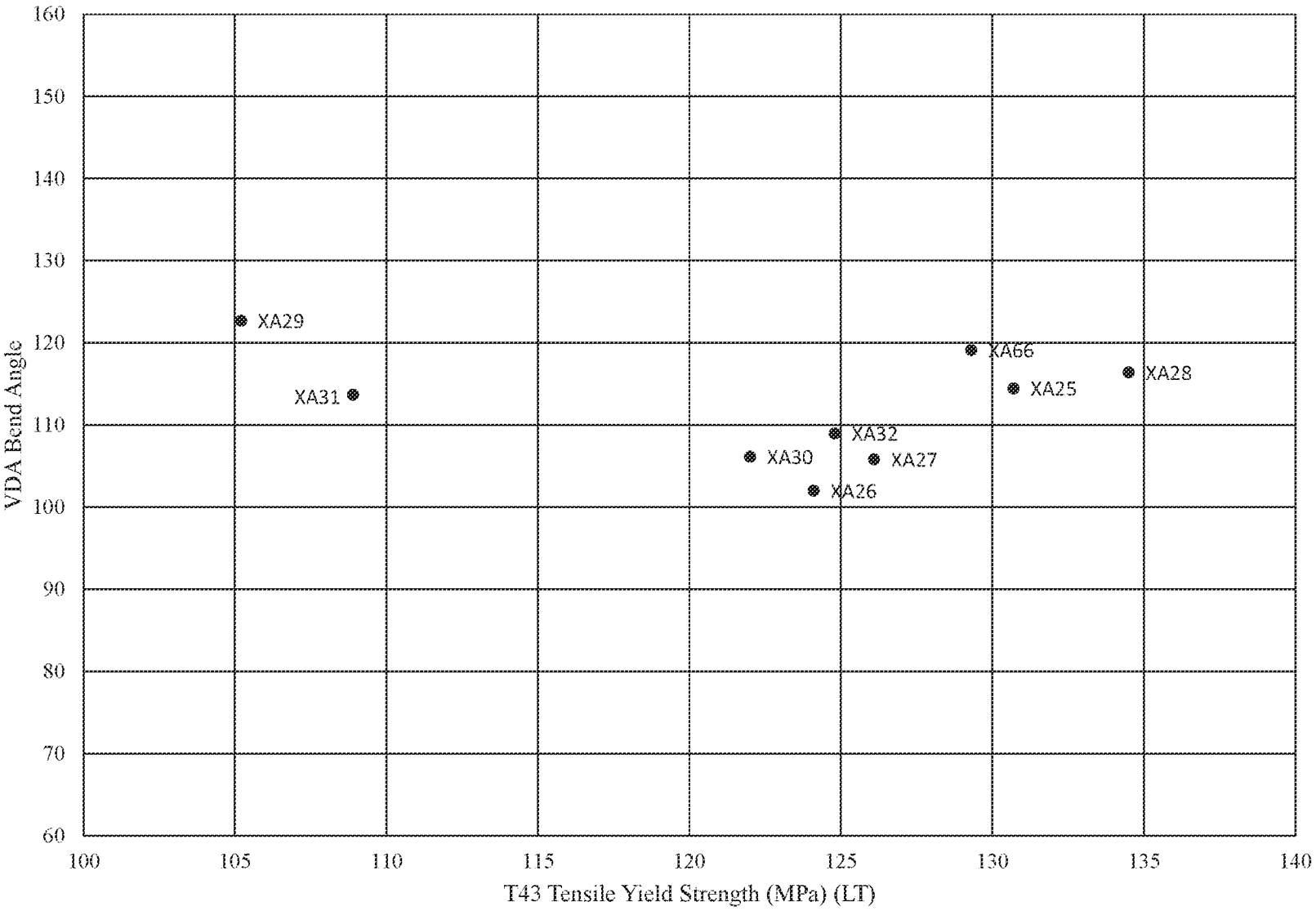

6XXX ALUMINUM ALLOYS AND METHODS FOR PRODUCING THE SAME

CROSS-REFERENCE

This application is a continuation of International Patent Application No. PCT/US2021/043898, filed Jul. 30, 2021, which claims the benefit of U.S. Provisional Patent Application No. 63/059,559, filed Jul. 31, 2020, entitled "NEW 6XXX ALUMINUM ALLOYS SHEET PRODUCTS," each of which is incorporated herein by reference in its entirety.

BACKGROUND

An aluminum alloy is a chemical composition where other elements are added to pure aluminum in order to enhance its properties, primarily to increase its strength. These other elements include iron, silicon, copper, magnesium, manganese and zinc at levels that combined may make up as much as 15 percent of the alloy by weight. Wrought aluminum alloys are assigned a four-digit number, in which the first digit identifies a general class, or series, characterized by its main alloying elements. See https://www.aluminum.org/resources/industry-standards/aluminum-alloys-101.

SUMMARY OF THE DISCLOSURE

Broadly, the present patent application relates to new 6xxx aluminum alloys and methods for producing the same. In one embodiment, a new 6xxx aluminum alloy includes from 0.25-0.60 wt. % Fe, 0.8-1.2 wt. % Si, 0.35-1.1 wt. % Mg, 0.05-0.8 wt. % Mn, up to 0.30 wt. % Cu, up to 0.50 wt. % Zn, up to 0.15 wt. % Ti, up to 0.15 wt. % each of Cr, Zr, and V, the balance being aluminum, incidental elements and impurities. The new 6xxx aluminum alloys products may be produced from one or more recycled materials (e.g., recycled aluminum alloys), making them cost effective. The new 6xxx aluminum alloy products may achieve an effective combination of properties due to, for instance, the employed chemical compositions. In one embodiment, the new 6xxx aluminum alloys are in the form of a sheet product. The new 6xxx aluminum alloys sheet products may be useful, for instance, in automotive applications, such as for use as an inner hood or door panel of an automobile.

I. Compositions

As noted above, the new 6xxx aluminum alloys generally comprise 0.25-0.60 wt. % Fe. High iron content facilitates the use of recycled material in the production of the new 6xxx aluminum alloy sheet products. It has been surprisingly predicted and found that the high iron content will also not materially deteriorate mechanical properties. In one embodiment, a new 6xxx aluminum alloy includes at least 0.27 wt. % Fe. In another embodiment, a new 6xxx aluminum alloy includes at least 0.30 wt. % Fe. In yet another embodiment, a new 6xxx aluminum alloy includes at least 0.33 wt. % Fe. In another embodiment, a new 6xxx aluminum alloy includes at least 0.36 wt. % Fe. In yet another embodiment, a new 6xxx aluminum alloy includes at least 0.39 wt. % Fe. In one embodiment, a new 6xxx aluminum alloy includes not greater than 0.57 wt. % Fe. In another embodiment, a new 6xxx aluminum alloy includes not greater than 0.54 wt. % Fe. In yet another embodiment, a new 6xxx aluminum alloy includes not greater than 0.51 wt. % Fe.

As noted, the new 6xxx aluminum alloys generally include from 0.8 to 1.2 wt. % Si and from 0.35 to 1.1 wt. % Mg. The combination of magnesium and silicon facilitates the production of the strengthening precipitate $Mg_2Si$. In one embodiment, a new 6xxx aluminum alloy includes at least 0.85 wt. % Si. In another embodiment, a new 6xxx aluminum alloy includes at least 0.90 wt. % Si. In yet another embodiment, a new 6xxx aluminum alloy includes at least 0.95 wt. % Si. In one embodiment, a new 6xxx aluminum alloy includes not greater than 1.15 wt. % Si. In another embodiment, a new 6xxx aluminum alloy includes not greater than 1.10 wt. % Si. In yet another embodiment, a new 6xxx aluminum alloy includes not greater than 1.05 wt. % Si.

In one embodiment, a new 6xxx aluminum alloy includes at least 0.40 wt. % Mg. In another embodiment, a new 6xxx aluminum alloy includes at least 0.45 wt. % Mg. In yet another embodiment, a new 6xxx aluminum alloy includes at least 0.50 wt. % Mg. In another embodiment, a new 6xxx aluminum alloy includes at least 0.55 wt. % Mg. In one embodiment, a new 6xxx aluminum alloy includes not greater than 1.05 wt. % Mg. In another embodiment, a new 6xxx aluminum alloy includes not greater than 1.0 wt. % Mg. In yet another embodiment, a new 6xxx aluminum alloy includes not greater than 0.95 wt. % Mg.

In one approach, a new 6xxx aluminum alloy includes a weight ratio of silicon-to-magnesium in the range of from 0.8:1 to 2.4:1 (Si:Mg) (e.g., to facilitate appropriate amounts of Mg2Si precipitates). In one embodiment, a new 6xxx aluminum alloy includes a weight ratio of silicon-to-magnesium of at least 0.9:1 (Si:Mg). In another embodiment, a new 6xxx aluminum alloy includes a weight ratio of silicon-to-magnesium of at least 1:1 (Si:Mg). In yet another embodiment, a new 6xxx aluminum alloy includes a weight ratio of silicon-to-magnesium of at least 1.1:1 (Si:Mg). In another embodiment, a new 6xxx aluminum alloy includes a weight ratio of silicon-to-magnesium of at least 1.2:1 (Si:Mg). In yet another embodiment, a new 6xxx aluminum alloy includes a weight ratio of silicon-to-magnesium of at least 1.3:1 (Si:Mg). In another embodiment, a new 6xxx aluminum alloy includes a weight ratio of silicon-to-magnesium of at least 1.4:1 (Si:Mg). In yet another embodiment, a new 6xxx aluminum alloy includes a weight ratio of silicon-to-magnesium of at least 1.5:1 (Si:Mg). In another embodiment, a new 6xxx aluminum alloy includes a weight ratio of silicon-to-magnesium of at least 1.6:1 (Si:Mg). In one embodiment, a new 6xxx aluminum alloy includes a weight ratio of silicon-to-magnesium of not greater than 2.3:1 (Si:Mg). In another embodiment, a new 6xxx aluminum alloy includes a weight ratio of silicon-to-magnesium of not greater than 2.2:1 (Si:Mg). In yet another embodiment, a new 6xxx aluminum alloy includes a weight ratio of silicon-to-magnesium of not greater than 2.1:1 (Si:Mg). In another embodiment, a new 6xxx aluminum alloy includes a weight ratio of silicon-to-magnesium of not greater than 2.0:1 (Si:Mg). In yet another embodiment, a new 6xxx aluminum alloy includes a weight ratio of silicon-to-magnesium of not greater than 1.9:1 (Si:Mg). In another embodiment, a new 6xxx aluminum alloy includes a weight ratio of silicon-to-magnesium of not greater than 1.8:1 (Si:Mg). In yet another embodiment, a new 6xxx aluminum alloy includes a weight ratio of silicon-to-magnesium of not greater than 1.7:1 (Si:Mg).

As noted above, the new 6xxx aluminum alloys generally include from 0.05 to 0.8 wt. % Mn. Manganese may facilitate, for instance, proper grain structure control. However, too much manganese may deleteriously affect elongation and fracture characteristics. In one embodiment, a new 6xxx aluminum alloy includes at least 0.08 wt. % Mn. In another embodiment, a new 6xxx aluminum alloy includes at least 0.10 wt. % Mn. In yet another embodiment, a new 6xxx aluminum alloy includes at least 0.12 wt. % Mn. In another embodiment, a new 6xxx aluminum alloy includes at least 0.15 wt. % Mn. In yet another embodiment, a new 6xxx aluminum alloy includes at least 0.18 wt. % Mn. In another embodiment, a new 6xxx aluminum alloy includes at least 0.20 wt. % Mn. In yet another embodiment, a new 6xxx aluminum alloy includes at least 0.25 wt. % Mn. In yet another embodiment, a new 6xxx aluminum alloy includes at least 0.30 wt. % Mn. In another embodiment, a new 6xxx aluminum alloy includes at least 0.33 wt. % Mn. In yet another embodiment, a new 6xxx aluminum alloy includes at least 0.35 wt. % Mn. In another embodiment, a new 6xxx aluminum alloy includes at least 0.38 wt. % Mn. In yet another embodiment, a new 6xxx aluminum alloy includes at least 0.40 wt. % Mn. In one embodiment, a new 6xxx aluminum alloy includes not greater than 0.75 wt. % Mn. In another embodiment, a new 6xxx aluminum alloy includes not greater than 0.70 wt. % Mn. In yet another embodiment, a new 6xxx aluminum alloy includes not greater than 0.65 wt. % Mn. In another embodiment, a new 6xxx aluminum alloy includes not greater than 0.60 wt. % Mn. In yet another embodiment, a new 6xxx aluminum alloy includes not greater than 0.55 wt. % Mn. In another embodiment, a new 6xxx aluminum alloy includes not greater than 0.50 wt. % Mn. In yet another embodiment, a new 6xxx aluminum alloy includes not greater than 0.45 wt. % Mn.

It has also been surprisingly found that high levels of both manganese and iron may be tolerated in the new 6xxx aluminum alloys. In one embodiment, a new 6xxx aluminum alloy includes at least 0.35 wt. % of iron plus manganese, i.e., (wt. % Fe)+(wt. % Mn)≥0.35 wt. %. In another embodiment, a new 6xxx aluminum alloy includes at least 0.40 wt. % of iron plus manganese, i.e., (wt. % Fe)+(wt. % Mn)≥0.40 wt. %. In yet another embodiment, a new 6xxx aluminum alloy includes at least 0.45 wt. % of iron plus manganese, i.e., (wt. % Fe)+(wt. % Mn)≥0.45 wt. %. In another embodiment, a new 6xxx aluminum alloy includes at least 0.50 wt. % of iron plus manganese, i.e., (wt. % Fe)+(wt. % Mn)≥0.50 wt. %. In yet another embodiment, a new 6xxx aluminum alloy includes at least 0.55 wt. % of iron plus manganese, i.e., (wt. % Fe)+(wt. % Mn)≥0.55 wt. %. In another embodiment, a new 6xxx aluminum alloy includes at least 0.60 wt. % of iron plus manganese, i.e., (wt. % Fe)+(wt. % Mn)≥0.60 wt. %. In yet another embodiment, a new 6xxx aluminum alloy includes at least 0.65 wt. % of iron plus manganese, i.e., (wt. % Fe)+(wt. % Mn)≥0.65 wt. %. In another embodiment, a new 6xxx aluminum alloy includes at least 0.70 wt. % of iron plus manganese, i.e., (wt. % Fe)+(wt. % Mn)≥0.70 wt. %. In yet another embodiment, a new 6xxx aluminum alloy includes at least 0.75 wt. % of iron plus manganese, i.e., (wt. % Fe)+(wt. % Mn)≥0.75 wt. %. In another embodiment, a new 6xxx aluminum alloy includes at least 0.80 wt. % of iron plus manganese, i.e., (wt. % Fe)+(wt. % Mn)≥0.80 wt. %.

As noted above, the new 6xxx aluminum alloys generally include up to 0.30 wt. % Cu. Too much copper may, for instance, negatively impact corrosion resistance and/or impact the ability to use recycled materials with the new 6xxx aluminum alloys. In one embodiment, a new 6xxx aluminum alloy includes not greater than 0.25 wt. % Cu. In another embodiment, a new 6xxx aluminum alloy includes not greater than 0.22 wt. % Cu. In yet another embodiment, a new 6xxx aluminum alloy includes not greater than 0.20 wt. % Cu. In another embodiment, a new 6xxx aluminum alloy includes not greater than 0.17 wt. % Cu. In yet another embodiment, a new 6xxx aluminum alloy includes not greater than 0.15 wt. % Cu. In one embodiment, a new 6xxx aluminum alloy includes at least 0.05 wt. % Cu. In another embodiment, a new 6xxx aluminum alloy includes at least 0.10 wt. % Cu.

As noted above, the new 6xxx aluminum alloys may include up to 0.50 wt. % Zn. Too much zinc may, for instance, negatively impact corrosion resistance and/or impact the ability to use recycled materials with the new 6xxx aluminum alloys. In one embodiment, a new 6xxx aluminum alloy includes not greater than 0.45 wt. % Zn. In another embodiment, a new 6xxx aluminum alloy includes not greater than 0.40 wt. % Zn. In another embodiment, a new 6xxx aluminum alloy includes not greater than 0.35 wt. % Zn. In yet another embodiment, a new 6xxx aluminum alloy includes not greater than 0.30 wt. % Zn. In another embodiment, a new 6xxx aluminum alloy includes not greater than 0.25 wt. % Zn. In yet another embodiment, a new 6xxx aluminum alloy includes not greater than 0.20 wt. % Zn. In another embodiment, a new 6xxx aluminum alloy includes not greater than 0.15 wt. % Zn. In yet another embodiment, a new 6xxx aluminum alloy includes not greater than 0.10 wt. % Zn. In another embodiment, a new 6xxx aluminum alloy includes not greater than 0.05 wt. % Zn. In yet another embodiment, a new 6xxx aluminum alloy includes not greater than 0.03 wt. % Zn. In some embodiments, zinc may be purposefully used. In these embodiments, a new 6xxx aluminum alloys generally includes at least 0.05 wt. % Zn, such as at least 0.10 wt. % Zn or at least 0.15 wt. % Zn, or at least 0.20 wt. % Zn.

As noted above, a new 6xxx aluminum alloy may include up to 0.15 wt. % each of Cr, Zr and V. These elements may facilitate, for instance, grain structure control. In one embodiment, at least one of Cr, Zr, and V is included in a new 6xxx aluminum alloy, wherein a new 6xxx aluminum alloy includes at least 0.05 wt. % of at least one of Cr, V and Z. In some embodiments, it is preferred to restrict zirconium and/or vanadium in favor of chromium. In one embodiment, a new 6xxx aluminum alloy includes not greater than 0.05 wt. % Zr or not greater than 0.03 wt. % Zr. In one embodiment, a new 6xxx aluminum alloy includes not greater than 0.05 wt. % V or not greater than 0.03 wt. % V. In one embodiment, an aluminum alloy is substantially free of chromium, containing less than 0.04 wt. % Cr.

As noted above, a new 6xxx aluminum alloy may include up to 0.15 wt. % Ti. Titanium may facilitate, for instance, grain refining. In one embodiment, a new 6xxx aluminum alloy includes at least 0.02 wt. % Ti. In another embodiment, a new 6xxx aluminum alloy includes at least 0.04 wt. % Ti. In one embodiment, a new 6xxx aluminum alloy includes not greater than 0.12 wt. % Ti. In another embodiment, a new 6xxx aluminum alloy includes not greater than 0.10 wt. % Ti.

As noted above, the new 6xxx aluminum alloys generally include the stated alloying ingredients, the balance being aluminum, optional incidental elements, and impurities. As used herein, "incidental elements" means those elements or materials, other than the above listed elements, that may optionally be added to the alloy to assist in the production of the alloy. Examples of incidental elements include casting aids, such as grain refiners and deoxidizers. Optional incidental elements may be included in the alloy in a cumulative amount of up to 1.0 wt. %. As one non-limiting example, one or more incidental elements may be added to the alloy during casting to reduce or restrict (and in some instances eliminate) ingot cracking due to, for example, oxide fold, pit and oxide patches. These types of incidental elements are generally referred to herein as deoxidizers. Examples of some deoxidizers include Ca, Sr, and Be. When calcium (Ca) is included in the alloy, it is generally present in an amount of up to about 0.05 wt. %, or up to about 0.03 wt. %. In some embodiments, Ca is included in the alloy in an amount of about 0.001-0.03 wt % or about 0.05 wt. %, such as 0.001-0.008 wt. % (or 10 to 80 ppm). Strontium (Sr) may be included in the alloy as a substitute for Ca (in whole or in part), and thus may be included in the alloy in the same or similar amounts as Ca. Traditionally, beryllium (Be) additions have helped to reduce the tendency of ingot cracking, though for environmental, health and safety reasons, some embodiments of the alloy are substantially Be-free. When Be is included in the alloy, it is generally present in an amount of up to about 20 ppm. Incidental elements may be present in minor amounts, or may be present in significant amounts, and may add desirable or other characteristics on their own without departing from the alloy described herein, so long as the alloy retains the desirable characteristics described herein. It is to be understood, however, that the scope of this disclosure should not/cannot be avoided through the mere addition of an element or elements in quantities that would not otherwise impact on the combinations of properties desired and attained herein.

The new 6xxx aluminum alloys may contain low amounts of impurities. In one embodiment, a new 6xxx aluminum alloy includes not greater than 0.15 wt. %, in total, of the impurities, and wherein the aluminum alloy includes not greater than 0.05 wt. % of each of the impurities. In another embodiment, a new 6xxx aluminum alloy includes not greater than 0.10 wt. %, in total, of the impurities, and wherein the aluminum alloy includes not greater than 0.03 wt. % of each of the impurities.

The new 6xxx aluminum alloys are generally substantially free of lithium, i.e., lithium is included only as an impurity, and generally at less than 0.04 wt. % Li, or less than 0.01 wt. % Li. The new 6xxx aluminum alloys are generally substantially free of silver, i.e., silver is included only as an impurity, and generally at less than 0.04 wt. % Ag, or less than 0.01 wt. % Ag. The new 6xxx aluminum alloys are generally substantially free of lead, i.e., lead is included only as an impurity, and generally at less than 0.04 wt. % Pb, or less than 0.01 wt. % Pb. The new 6xxx aluminum alloys are generally substantially free of cadmium, i.e., cadmium is included only as an impurity, and generally at less than 0.04 wt. % Cd, or less than 0.01 wt. % Cd. The new 6xxx aluminum alloys are generally substantially free of thallium, i.e., thallium is included only as an impurity, and generally at less than 0.04 wt. % Tl, or less than 0.01 wt. % Tl. The new 6xxx aluminum alloys are generally substantially free of scandium, i.e., scandium is included only as an impurity, and generally at less than 0.04 wt. % Sc, or less than 0.01 wt. % Sc. The new 6xxx aluminum alloys are generally substantially free of nickel, i.e., nickel is included only as an impurity, and generally at less than 0.04 wt. % Ni, or less than 0.01 wt. % Ni.

II. Methods of Production

The new 6xxx aluminum alloys sheet products may be processed by casting (e.g., direct chill cast or continuously cast) into an ingot/billet or strip. In one embodiment, a method includes casting an ingot of any of the aluminum alloys described in Section I, above, followed by homogenization, scalping, lathing or peeling (if needed). After casting, the ingot/strip may be worked (hot and/or cold worked) into a final or intermediate gauge product. After working, the new aluminum alloys may be processed to one of a T temper, a W temper, or an F temper as per ANSI H35.1 (2009). In one embodiment, a new aluminum alloy is processed to a "T temper" (thermally treated). In this regard, the new aluminum alloys may be processed to any of a T1, T2, T3, T4, T5, T6, T7, T8, T9 or T10 temper as per ANSI H35.1 (2009).

In one embodiment, a method may include casting an ingot or strip of any of the aluminum alloys described in Section I followed by hot rolling the aluminum alloy to an intermediate gauge product or final gauge product. If the hot rolling results in an intermediate gauge product, the product may be cold rolled to a final gauge. In one embodiment, the final gauge sheet product has a thickness of from 0.5 to 4.0 mm. The final gauge product may then be solution heat treated and then quenched (e.g., water quenching; air quenching). Next, the final gauge product may be naturally aged, thereby realizing a T4 temper. Alternatively, after solution heat treating and quenching, the final gauge product may be pre-aged (e.g., at 180° F. for 8 hours) and then stabilized by natural aging at room temperature, thereby realizing a T43 temper. In one embodiment, the final gauge product is formed into an automotive component. In one embodiment, the formed automotive component is an inner door panel of an automobile. In one embodiment, a method may include precipitation hardening of the final gauge product. In one embodiment, the precipitation hardening follows the forming step. In one embodiment, the precipitation hardening comprises paint baking of the final gauge product.

In other embodiments, the new 6xxx aluminum alloy is processed into another wrought product form, such as into one of a plate, extrusion or a forging. Such wrought product may also be processed to a T temper, such as any of the T tempers described above, including the T4, T43 and T6 tempers, among others, and may be of any suitable shape and thickness.

As noted above, recycled materials may be used to produce the 6xxx aluminum alloys. The recycled materials may be, for instance, scrap aluminum alloys, such as scrap and/or recovered aluminum alloys previously used. As a few non-limiting examples, the recycled materials may be aluminum alloys from beverage cans, brazing materials, automobiles, or from industrial applications. In one embodiment, a recycled material is not a 6xxx aluminum alloy. That is, the recycled material is of a composition that is different than that of a 6xxx aluminum alloy. For example, when the recycled materials come from beverage cans, the recycled materials may be 3xxx or 4xxx aluminum alloys, for instance. When the recycled materials come from brazing materials or industrial, the recycled materials may be 3xxx, 4xxx or 5xxx aluminum alloys, for instance. When the recycled materials come from automotive applications, the recycled materials may be 5xxx or 7xxx aluminum alloys, for instance. In other embodiments, the recycled materials have a 6xxx aluminum alloy composition (e.g., from automotive, brazing and/or aerospace applications).

In one embodiment, a method comprises utilizing recycled aluminum alloy materials to produce an ingot/billet or the strip. For instance, the recycled materials may be added to melting furnaces along with non-recycled aluminum materials (e.g., aluminum prime; high purity metals, such as silicon, magnesium, copper and/or zinc). After casting using the recycled and non-recycled materials, the ingot/billet or strip will realize a 6xxx aluminum alloy composition, such as any of the 6xxx aluminum alloys described in Section I, above.

As noted above, the recycled materials may have high iron and/or manganese contents. In one embodiment, the recycled material is an aluminum alloy having at least 0.25 wt. % Fe. In another embodiment, the recycled material is an aluminum alloy having at least 0.27 wt. % Fe. In yet another embodiment, the recycled material is an aluminum alloy having at least 0.30 wt. % Fe. In another embodiment, the recycled material is an aluminum alloy having at least 0.33 wt. % Fe. In yet another embodiment, the recycled material is an aluminum alloy having at least 0.36 wt. % Fe. In another embodiment, the recycled material is an aluminum alloy having at least 0.39 wt. % Fe.

In one embodiment, the recycled material is an aluminum alloy having at least 0.05 wt. % Mn. In another embodiment, the recycled material is an aluminum alloy having at least 0.08 wt. % Mn. In yet another embodiment, the recycled material is an aluminum alloy having at least 0.10 wt. % Mn. In another embodiment, the recycled material is an aluminum alloy having at least 0.12 wt. % Mn. In yet another embodiment, the recycled material is an aluminum alloy having at least 0.15 wt. % Mn. In another embodiment, the recycled material is an aluminum alloy having at least 0.20 wt. % Mn. In yet another embodiment, the recycled material is an aluminum alloy having at least 0.25 wt. % Mn. In another embodiment, the recycled material is an aluminum alloy having at least 0.30 wt. % Mn. In yet another embodiment, the recycled material is an aluminum alloy having at least 0.33 wt. % Mn. In another embodiment, the recycled material is an aluminum alloy having at least 0.35 wt. % Mn. In yet another embodiment, the recycled material is an aluminum alloy having at least 0.38 wt. % Mn. In another embodiment, the recycled material is an aluminum alloy having at least 0.40 wt. % Mn.

III. Properties

As noted above, the new aluminum alloys may realize an improved combination of properties, such as an improved combination of two or more of formability, strength, ductility, corrosion resistance, weldability, and fracture toughness, among others.

i. T4 or T43 Properties

In one embodiment, a new aluminum alloy realizes an ultimate tensile strength (typical) ("UTS") of not greater than 215 MPa in the T4 or T43 temper. High strengths in the T4 or T43 temper may negatively impact the ability to properly form the new 6xxx aluminum alloy sheet product. In one embodiment, a new aluminum alloy realizes a tensile yield strength (typical) ("TYS") of from 100-155 MPa in the T4 or T43 temper. In one embodiment, a new aluminum alloy realizes a total elongation (typical) of from 15-27% in the T4 or T43 temper. In another embodiment, a new aluminum alloy realizes an elongation (typical) of from 15-23% in the T4 or T43 temper. The above strength and elongation values may be achieved in the longitudinal (L), long transverse (LT) and/or 45° directions.

In one embodiment, a new aluminum alloy realizes a TYS (LT) of not greater than 135 MPa in the T4 or T43 temper at 7 days of natural aging. In another embodiment, a new aluminum alloy realizes a TYS (LT) of not greater than 130 MPa in the T4 or T43 temper at 7 days of natural aging. In yet another embodiment, a new aluminum alloy realizes a TYS (LT) of not greater than 125 MPa in the T4 or T43 temper at 7 days of natural aging. In another embodiment, a new aluminum alloy realizes a TYS (LT) of not greater than 120 MPa in the T4 or T43 temper at 7 days of natural aging.

In one embodiment, a new aluminum alloy realizes a TYS (LT) of not greater than 140 MPa in the T4 or T43 temper at 30 days of natural aging. In another embodiment, a new aluminum alloy realizes a TYS (LT) of not greater than 135 MPa in the T4 or T43 temper at 30 days of natural aging. In yet another embodiment, a new aluminum alloy realizes a TYS (LT) of not greater than 130 MPa in the T4 or T43 temper at 30 days of natural aging. In another embodiment, a new aluminum alloy realizes a TYS (LT) of not greater than 125 MPa in the T4 or T43 temper at 30 days of natural aging.

In one embodiment, a new aluminum alloy realizes a TYS (LT) of not greater than 150 MPa in the T4 or T43 temper at 90 days of natural aging. In another embodiment, a new aluminum alloy realizes a TYS (LT) of not greater than 145 MPa in the T4 or T43 temper at 90 days of natural aging. In yet another embodiment, a new aluminum alloy realizes a TYS (LT) of not greater than 140 MPa in the T4 or T43 temper at 90 days of natural aging. In another embodiment, a new aluminum alloy realizes a TYS (LT) of not greater than 135 MPa in the T4 or T43 temper at 90 days of natural aging.

In one embodiment, a new aluminum alloy realizes a TYS (LT) of not greater than 155 MPa in the T4 or T43 temper at 180 days of natural aging. In another embodiment, a new aluminum alloy realizes a TYS (LT) of not greater than 150 MPa in the T4 or T43 temper at 180 days of natural aging. In yet another embodiment, a new aluminum alloy realizes a TYS (LT) of not greater than 145 MPa in the T4 or T43 temper at 180 days of natural aging. In another embodiment, a new aluminum alloy realizes a TYS (LT) of not greater than 140 MPa in the T4 or T43 temper at 180 days of natural aging. In yet another embodiment, a new aluminum alloy realizes a TYS (LT) of not greater than 135 MPa in the T4 or T43 temper at 180 days of natural aging.

In one embodiment, a new aluminum alloy realizes a total elongation (LT) of at least 18% in the T4 or T43 temper. In another embodiment, a new aluminum alloy realizes a total elongation (LT) of at least 19% in the T4 or T43 temper. In yet another embodiment, a new aluminum alloy realizes a total elongation (LT) of at least 20% in the T4 or T43 temper. In another embodiment, a new aluminum alloy realizes a total elongation (LT) of at least 21% in the T4 or T43 temper. In yet another embodiment, a new aluminum alloy realizes a total elongation (LT) of at least 22% in the T4 or T43 temper. The above stated T4 or T43 total elongation (LT) levels may be realized with any of 7 days, 30 days, 90 days, or 180 days of natural aging.

In one approach, a new aluminum alloy in the T4 or T43 temper realizes a delta r (Δr) of not greater than 0.20 at 30 days of natural aging, wherein delta r is calculated from the L, LT and 45° "r at 10%" values as follows: Absolute Value [(r_L+r_LT−2*r_45)/2], wherein r_L is the "r at 10%" value" in the L direction, r_LT is the "r at 10%" value in the LT direction, and r_45 is the "r at 10%" value in the 45° direction. A low delta r value is preferred and indicates isotropic forming properties. The "r at 10%" value is determined as the ratio of the true strain in the width direction to the true strain in the thickness direction; the calculation method is provided in ASTM E517. In one embodiment, a new aluminum alloy realizes a delta r (Δr) of not greater than 0.18. In another embodiment, a new aluminum alloy realizes a delta r (Δr) of not greater than 0.16. In yet another embodiment, a new aluminum alloy realizes a delta r (Δr) of not greater than 0.14. In another embodiment, a new aluminum alloy realizes a delta r (Δr) of not greater than 0.12. In yet another embodiment, a new aluminum alloy realizes a delta r (Δr) of not greater than 0.10. In another embodiment, a new aluminum alloy realizes a delta r (Δr) of not greater than 0.09. In yet another embodiment, a new aluminum alloy realizes a delta r (Δr) of not greater than 0.08. In another embodiment, a new aluminum alloy realizes a delta r (Δr) of not greater than 0.07. In yet another embodiment, a new aluminum alloy realizes a delta r (Δr) of not greater than 0.06. In another embodiment, a new aluminum alloy realizes a delta r (Δr) of not greater than 0.05. In yet another embodiment, a new aluminum alloy realizes a delta r (Δr) of not greater than 0.04. In another embodiment, a new aluminum alloy realizes a delta r (Δr) of not greater than 0.03.

In one approach, a new aluminum alloy in the T4 or T43 temper realizes a n (4-6%) value of at least 0.265 when tested in accordance with ASTM E646. An "n value (4-6%)" is determined as the slope of the plastic portion of the stress strain curve between 4 and 6% elongation; the calculation method is provided in ASTM E646. A high n value indicates a material can distribute strain more uniformly during a forming operation and thus elongate further prior to necking, which improves formability. In one embodiment, a new aluminum alloy in the T4 or T43 temper realizes a n (4-6%) value of at least 0.267 when tested in accordance with ASTM E646. In another embodiment, a new aluminum alloy in the T4 or T43 temper realizes a n (4-6%) value of at least 0.270 when tested in accordance with ASTM E646. In yet another embodiment, a new aluminum alloy in the T4 or T43 temper realizes a n (4-6%) value of at least 0.271 when tested in accordance with ASTM E646. In another embodiment, a new aluminum alloy in the T4 or T43 temper realizes a n (4-6%) value of at least 0.272 when tested in accordance with ASTM E646. In yet another embodiment, a new aluminum alloy in the T4 or T43 temper realizes a n (4-6%) value of at least 0.273 when tested in accordance with ASTM E646. In yet another embodiment, a new aluminum alloy in the T4 or T43 temper realizes a n (4-6%) value of at least 0.274 when tested in accordance with ASTM E646. In another embodiment, a new aluminum alloy in the T4 or T43 temper realizes a n (4-6%) value of at least 0.275 when tested in accordance with ASTM E646. In yet another embodiment, a new aluminum alloy in the T4 or T43 temper realizes a n (4-6%) value of at least 0.276 when tested in accordance with ASTM E646. In another embodiment, a new aluminum alloy in the T4 or T43 temper realizes a n (4-6%) value of at least 0.277 when tested in accordance with ASTM E646. In yet another embodiment, a new aluminum alloy in the T4 or T43 temper realizes a n (4-6%) value of at least 0.278 when tested in accordance with ASTM E646. In another embodiment, a new aluminum alloy in the T4 or T43 temper realizes a n (4-6%) value of at least 0.279 when tested in accordance with ASTM E646.

ii. Post-Paint Bake Properties

High strength after paint baking is desirable because the product is generally already formed prior to paint baking and high strength aluminum alloy materials are desirable in their final form. High elongation is also desirable.

In one approach, a new aluminum alloy realizes a TYS (LT) of at least 180 MPa after paint baking a T4 or T43 temper material without any prestrain (i.e., 0% prestretch), wherein the paint baking comprises artificially aging at 365° F. for 20 minutes. High strength after paint baking is desirable because the product is generally already formed prior to paint baking and high strength aluminum alloy materials are desirable in their final form. In one embodiment, a new aluminum alloy realizes a TYS (LT) of at least 185 MPa after paint baking a T4 or T43 temper material without any prestrain (i.e., 0% prestretch), wherein the paint baking comprises artificially aging at 365° F. for 20 minutes. In another embodiment, a new aluminum alloy realizes a TYS (LT) of at least 190 MPa after paint baking a T4 or T43 temper material without any prestrain (i.e., 0% prestretch), wherein the paint baking comprises artificially aging at 365° F. for 20 minutes. In yet another embodiment, a new aluminum alloy realizes a TYS (LT) of at least 195 MPa after paint baking a T4 or T43 temper material without any prestrain (i.e., 0% prestretch), wherein the paint baking comprises artificially aging at 365° F. for 20 minutes. In another embodiment, a new aluminum alloy realizes a TYS (LT) of at least 200 MPa after paint baking a T4 or T43 temper material without any prestrain (i.e., 0% prestretch), wherein the paint baking comprises artificially aging at 365° F. for 20 minutes. In yet another embodiment, a new aluminum alloy realizes a TYS (LT) of at least 205 MPa after paint baking a T4 or T43 temper material without any prestrain (i.e., 0% prestretch), wherein the paint baking comprises artificially aging at 365° F. for 20 minutes. In another embodiment, a new aluminum alloy realizes a TYS (LT) of at least 210 MPa after paint baking a T4 or T43 temper material without any prestrain (i.e., 0% prestretch), wherein the paint baking comprises artificially aging at 365° F. for 20 minutes. In yet another embodiment, a new aluminum alloy realizes a TYS (LT) of at least 215 MPa after paint baking a T4 or T43 temper material without any prestrain (i.e., 0% prestretch), wherein the paint baking comprises artificially aging at 365° F. for 20 minutes. The above stated paint bake TYS (LT) levels may be realized with any of 7 days, 30 days, 90 days, or 180 days of natural aging.

In one embodiment, a new aluminum alloy realizes a TYS (LT) of at least 230 MPa after paint baking a T4 or T43 temper material with 2% prestrain (i.e., 2% prestretch), wherein the paint baking comprises artificially aging at 365° F. for 20 minutes. In another embodiment, a new aluminum alloy realizes a TYS (LT) of at least 235 MPa after paint baking a T4 or T43 temper material with 2% prestrain (i.e., 2% prestretch), wherein the paint baking comprises artificially aging at 365° F. for 20 minutes. In yet another embodiment, a new aluminum alloy realizes a TYS (LT) of at least 240 MPa after paint baking a T4 or T43 temper material with 2% prestrain (i.e., 2% prestretch), wherein the paint baking comprises artificially aging at 365° F. for 20 minutes. In another embodiment, a new aluminum alloy realizes a TYS (LT) of at least 245 MPa after paint baking a T4 or T43 temper material with 2% prestrain (i.e., 2% prestretch), wherein the paint baking comprises artificially aging at 365° F. for 20 minutes. In yet another embodiment, a new aluminum alloy realizes a TYS (LT) of at least 250 MPa after paint baking a T4 or T43 temper material with 2% prestrain (i.e., 2% prestretch), wherein the paint baking comprises artificially aging at 365° F. for 20 minutes. In another embodiment, a new aluminum alloy realizes a TYS (LT) of at least 255 MPa after paint baking a T4 or T43 temper material with 2% prestrain (i.e., 2% prestretch), wherein the paint baking comprises artificially aging at 365° F. for 20 minutes. In yet another embodiment, a new aluminum alloy realizes a TYS (LT) of at least 260 MPa after paint baking a T4 or T43 temper material with 2% prestrain (i.e., 2% prestretch), wherein the paint baking comprises artificially aging at 365° F. for 20 minutes. In another embodiment, a new aluminum alloy realizes a TYS (LT) of at least 265 MPa after paint baking a T4 or T43 temper material with 2% prestrain (i.e., 2% prestretch), wherein the paint baking comprises artificially aging at 365° F. for 20 minutes. In yet another embodiment, a new aluminum alloy realizes a TYS (LT) of at least 270 MPa after paint baking a T4 or T43 temper material with 2% prestrain (i.e., 2% prestretch), wherein the paint baking comprises artificially aging at 365° F. for 20 minutes. The above stated paint bake TYS (LT) levels may be realized with any of 7 days, 30 days, 90 days, or 180 days of natural aging.

In one embodiment, a new aluminum alloy realizes a total elongation (LT) of at least 15% after paint baking a T4 or T43 temper material without any prestrain (i.e., 0% prestretch), wherein the paint baking comprises artificially aging at 365° F. for 20 minutes. In another embodiment, a new aluminum alloy realizes a total elongation (LT) of at least 16% after paint baking a T4 or T43 temper material without any prestrain (i.e., 0% prestretch), wherein the paint baking comprises artificially aging at 365° F. for 20 minutes. In yet another embodiment, a new aluminum alloy realizes a total elongation (LT) of at least 17% after paint baking a T4 or T43 temper material without any prestrain (i.e., 0% prestretch), wherein the paint baking comprises artificially aging at 365° F. for 20 minutes. In another embodiment, a new aluminum alloy realizes a total elongation (LT) of at least 18% after paint baking a T4 or T43 temper material without any prestrain (i.e., 0% prestretch), wherein the paint baking comprises artificially aging at 365° F. for 20 minutes. In another embodiment, a new aluminum alloy realizes a total elongation (LT) of at least 19% after paint baking a T4 or T43 temper material without any prestrain (i.e., 0% prestretch), wherein the paint baking comprises artificially aging at 365° F. for 20 minutes. In another embodiment, a new aluminum alloy realizes a total elongation (LT) of at least 20% after paint baking a T4 or T43 temper material without any prestrain (i.e., 0% prestretch), wherein the paint baking comprises artificially aging at 365° F. for 20 minutes. In another embodiment, a new aluminum alloy realizes a total elongation (LT) of at least 21% after paint baking a T4 or T43 temper material without any prestrain (i.e., 0% prestretch), wherein the paint baking comprises artificially aging at 365° F. for 20 minutes. The stated paint bake total elongation (LT) levels may be realized with any of 7 days, 30 days, 90 days, or 180 days of natural aging.

In one embodiment, a new aluminum alloy realizes a total elongation of at least 13% after paint baking a T43 temper material with 2% prestrain (i.e., 2% prestretch), wherein the paint baking comprises artificially aging at 365° F. for 20 minutes. In another embodiment, a new aluminum alloy realizes a total elongation of at least 14% after paint baking a T43 temper material with 2% prestrain (i.e., 2% prestretch), wherein the paint baking comprises artificially aging at 365° F. for 20 minutes. In yet another embodiment, a new aluminum alloy realizes a total elongation of at least 15% after paint baking a T43 temper material with 2% prestrain (i.e., 2% prestretch), wherein the paint baking comprises artificially aging at 365° F. for 20 minutes. In another embodiment, a new aluminum alloy realizes a total elongation of at least 16% after paint baking a T43 temper material with 2% prestrain (i.e., 2% prestretch), wherein the paint baking comprises artificially aging at 365° F. for 20 minutes. In another embodiment, a new aluminum alloy realizes a total elongation of at least 17% after paint baking a T43 temper material with 2% prestrain (i.e., 2% prestretch), wherein the paint baking comprises artificially aging at 365° F. for 20 minutes. In another embodiment, a new aluminum alloy realizes a total elongation of at least 18% after paint baking a T43 temper material with 2% prestrain (i.e., 2% prestretch), wherein the paint baking comprises artificially aging at 365° F. for 20 minutes. The stated paint bake total elongation (LT) levels may be realized with any of 7 days, 30 days, 90 days, or 180 days of natural aging.

IV. Product Applications

The new aluminum alloys described herein may be used in a variety of product applications, such as in automotive and/or industrial applications. For instance, the new alloys may be used as inner hood or door panel of an automobile. Aside from sheet products, the new aluminum alloys described herein may also find use in other wrought product forms, such as in plate, extruded and/or forged product form.

V. Definitions

"Wrought aluminum alloy product" means an aluminum alloy product that is hot worked after casting, and includes rolled products (sheet or plate), forged products, and extruded products.

"Hot working" means working the aluminum alloy product at elevated temperature, and generally at least 250° F. Strain-hardening is restricted/avoided during hot working, which generally differentiates hot working from cold working.

"Cold working" means working the aluminum alloy product at temperatures that are not considered hot working temperatures, generally below about 250° F. (e.g., at ambient).

Strength and elongation are measured in accordance with ASTM E8 and B557.

Temper definitions are per ANSI H35.1 (2009), entitled "American National Standard Alloy and Temper Designation Systems for Aluminum," published by The Aluminum Association.

A "T43 temper" is a special T4 temper wherein, after solution heat treatment and quenching, a material is pre-aged (e.g., at 180° F. for 8 hours) before it is stabilized by natural aging at room temperature.

VI. Miscellaneous

These and other aspects, advantages, and novel features of this new technology are set forth in part in the description that follows and will become apparent to those skilled in the art upon examination of the following description and figures or may be learned by practicing one or more embodiments of the technology provided for by the present disclosure.

The figures constitute a part of this specification and include illustrative embodiments of the present disclosure and illustrate various objects and features thereof. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though they may. Furthermore, the phrases "in another embodiment" and "in some other embodiments" as used herein do not necessarily refer to a different embodiment, although they may. Thus, various embodiments of the invention may be readily combined, without departing from the scope or spirit of the invention.

In addition, as used herein, the term "or" is an inclusive "or" operator and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references, unless the context clearly dictates otherwise. The meaning of "in" includes "in" and "on", unless the context clearly dictates otherwise.

BRIEF DESCRIPTION OF THE DRAWINGS

FIGS. 1-2 are graphs illustrating the tensile yield strength and total elongation properties of the Example 1 alloys in various conditions.

FIG. 3 is a graph illustrating the tensile yield strength and VDA bend results for the Example 1 alloys in the T43 temper.

DETAILED DESCRIPTION

Example 1

Nine pilot-scale ingots of the aluminum alloys shown in Table 1 were conventionally scalped/peeled and then homogenized.

TABLE 1

Composition of Ex, 1 Alloys (in wt. %)*

| Alloy** | Si | Fe | Cu | Mn | Mg | Cr | Zn | Ti |
|---|---|---|---|---|---|---|---|---|
| XA25 | 1.00 | 0.44 | 0.16 | 0.40 | 0.60 | 0.03 | 0.03 | 0.02 |
| XA26 | 0.99 | 0.42 | 0.15 | 0.38 | 0.90 | 0.03 | 0.04 | 0.02 |
| XA27 | 1.00 | 0.17 | 0.16 | 0.40 | 0.62 | 0.03 | 0.03 | 0.02 |
| XA28 | 1.01 | 0.44 | 0.14 | 0.39 | 0.60 | 0.03 | 0.31 | 0.02 |
| XA29 | 0.98 | 0.44 | 0.16 | 0.41 | 0.40 | 0.03 | 0.02 | 0.02 |
| XA30 | 0.98 | 0.44 | 0.14 | 0.41 | 0.65 | 0.15 | 0.03 | 0.02 |
| XA31 | 0.63 | 0.40 | 0.14 | 0.41 | 0.89 | 0.03 | 0.02 | 0.02 |
| XA32 | 0.98 | 0.43 | 0.15 | 0.15 | 0.62 | 0.03 | 0.02 | 0.02 |
| XA66 | 0.81 | 0.13 | 0.05 | 0.07 | 0.59 | 0.03 | 0.02 | 0.02 |

*The balance of the alloy was incidental elements and impurities, where the alloy contained not greater than 0.03 wt. % of any one impurity, and where the alloy contained not greater than 0.10 wt. %, in total, of all impurities.
**Alloy XA66 is a baseline alloy showing the level of performance in a low-iron 6xxx aluminum alloy. Alloys XA25-28, XA30, and XA32 are invention alloys. Alloys XA29 and XA31 are non-invention alloys.

The ingots were then hot rolled to 3.53 mm (0.135 inch) followed by cold rolling (without any intermediate anneal) by about 70% to a final gauge of 1.02 mm (0.040 inch). The final gauge materials were then solution heat treated, air quenched and then processed to a T43 temper. The mechanical properties of the alloys were evaluated after naturally aging at 7, 30, 90 and 180 days, the results of which are shown in Tables 2-3 and 5-6, below. The delta r properties (Δr) at 30 days of natural aging were also calculated, the results of which are shown in Table 4, below, wherein delta r is calculated from the L, LT and 45° "r at 10" values, as explained above. A low delta r value is preferred and means a material is more isotropic.

Strength and elongation are measured in accordance with ASTM E8 and B557. An "n value (4-6%)" is determined as the slope of the plastic portion of the stress strain curve between 4 and 6% elongation; the calculation method is provided in ASTM E646.

TABLE 2

Mechanical Properties at 7 days of Natural Aging

| Alloy | Direction | TYS (MPa) | UTS (MPa) | UTS − TYS (MPa) | Total Elong. (%) |
|---|---|---|---|---|---|
| XA25 | 45 | 122.7 | 258.6 | 135.8 | 24.3 |
| XA26 | 45 | 120.0 | 254.4 | 134.4 | 24.5 |
| XA27 | 45 | 117.2 | 252.0 | 134.8 | 23.8 |
| XA28 | 45 | 119.3 | 254.8 | 135.5 | 25.0 |
| XA29 | 45 | 96.5 | 222.7 | 126.2 | 21.3 |
| XA30 | 45 | 115.8 | 250.6 | 134.8 | 23.3 |
| XA31 | 45 | 98.9 | 227.2 | 128.2 | 21.8 |
| XA32 | 45 | 115.8 | 249.6 | 133.8 | 24.2 |
| XA66 | 45 | 122.7 | 258.6 | 135.9 | 24.3 |
| XA25 | L | 128.2 | 266.1 | 137.9 | 25.0 |
| XA26 | L | 122.0 | 259.9 | 137.9 | 24.1 |
| XA27 | L | 122.4 | 260.6 | 138.2 | 24.2 |
| XA28 | L | 125.8 | 264.8 | 138.9 | 24.2 |
| XA29 | L | 98.6 | 228.2 | 129.6 | 21.5 |
| XA30 | L | 121.0 | 260.3 | 139.3 | 21.9 |
| XA31 | L | 101.7 | 233.7 | 132.0 | 23.3 |
| XA32 | L | 120.0 | 255.1 | 135.1 | 25.1 |
| XA66 | L | 128.3 | 254.4 | 126.1 | 25.0 |
| XA25 | LT | 122.7 | 254.4 | 131.7 | 21.5 |
| XA26 | LT | 112.4 | 241.3 | 128.9 | 22.7 |
| XA27 | LT | 120.3 | 253.7 | 133.4 | 21.5 |
| XA28 | LT | 125.1 | 260.6 | 135.5 | 23.2 |
| XA29 | LT | 96.5 | 223.7 | 127.2 | 20.8 |
| XA30 | LT | 121.7 | 257.5 | 135.8 | 21.0 |
| XA31 | LT | 97.2 | 221.0 | 123.8 | 18.6 |
| XA32 | LT | 116.9 | 247.5 | 130.7 | 21.9 |
| XA66 | LT | 122.7 | 254.4 | 131.7 | 21.5 |

TABLE 3

Mechanical Properties at 30 days of Natural Aging

| Alloy | Direction | TYS (MPa) | UTS (MPa) | UTS − TYS (MPa) | Total Elong. (%) |
|---|---|---|---|---|---|
| XA25 | 45 | 127.9 | 259.9 | 132.0 | 24.6 |
| XA26 | 45 | 124.8 | 256.5 | 131.7 | 21.4 |
| XA27 | 45 | 123.1 | 255.5 | 132.4 | 24.7 |
| XA28 | 45 | 124.8 | 258.6 | 133.8 | 25.1 |
| XA29 | 45 | 103.1 | 228.9 | 125.8 | 21.9 |
| XA30 | 45 | 124.5 | 257.2 | 132.7 | 23.2 |
| XA31 | 45 | 106.2 | 232.7 | 126.5 | 21.2 |
| XA32 | 45 | 120.3 | 251.0 | 130.7 | 24.0 |
| XA66 | 45 | 129.6 | 249.3 | 119.6 | 25.1 |
| XA25 | L | 131.3 | 265.8 | 134.4 | 23.0 |
| XA26 | L | 128.2 | 263.0 | 134.8 | 24.2 |
| XA27 | L | 123.4 | 258.9 | 135.5 | 23.2 |
| XA28 | L | 131.0 | 268.9 | 137.9 | 24.3 |
| XA29 | L | 107.2 | 235.1 | 127.9 | 20.0 |
| XA30 | L | 126.9 | 263.7 | 136.9 | 21.6 |
| XA31 | L | 108.9 | 238.6 | 129.6 | 22.4 |
| XA32 | L | 127.6 | 261.0 | 133.4 | 24.6 |
| XA66 | L | 134.8 | 257.5 | 122.7 | 24.2 |
| XA25 | LT | 131.7 | 260.6 | 128.9 | 21.0 |
| XA26 | LT | 128.9 | 259.6 | 130.7 | 22.0 |
| XA27 | LT | 121.0 | 250.3 | 129.3 | 20.2 |
| XA28 | LT | 128.6 | 262.3 | 133.8 | 22.5 |
| XA29 | LT | 103.1 | 228.9 | 125.8 | 22.3 |

TABLE 3-continued

| Mechanical Properties at 30 days of Natural Aging | | | | | |
|---|---|---|---|---|---|
| Alloy | Direction | TYS (MPa) | UTS (MPa) | UTS – TYS (MPa) | Total Elong. (%) |
| XA30 | LT | 126.9 | 259.6 | 132.7 | 20.9 |
| XA31 | LT | 104.5 | 228.6 | 124.1 | 19.8 |
| XA32 | LT | 122.4 | 251.0 | 128.6 | 22.1 |
| XA66 | LT | 127.6 | 243.4 | 115.8 | 24.1 |

TABLE 4

| Delta R Properties at 30 days of Natural Aging | |
|---|---|
| Alloy | Delta r |
| XA25 | 0.025 |
| XA26 | 0.125 |
| XA27 | 0.040 |
| XA28 | 0.050 |
| XA29 | 0.070 |
| XA30 | 0.130 |
| XA31 | 0.095 |
| XA32 | 0.038 |
| XA66 | 0.243 |

TABLE 5

| Mechanical Properties at 90 days of Natural Aging | | | | | |
|---|---|---|---|---|---|
| Alloy | Direction | TYS (MPa) | UTS (MPa) | UTS – TYS (MPa) | Total Elong. (%) |
| XA25 | LT | 143.4 | 272.7 | 129.3 | 20.0 |
| XA26 | LT | 137.9 | 268.9 | 131.0 | 23.0 |
| XA27 | LT | 128.6 | 258.6 | 130.0 | 19.8 |
| XA28 | LT | 137.9 | 272.7 | 134.8 | 23.1 |
| XA29 | LT | 110.0 | 236.8 | 126.9 | 21.7 |
| XA30 | LT | 136.2 | 269.2 | 133.1 | 20.3 |
| XA31 | LT | 110.7 | 235.8 | 125.1 | 18.2 |
| XA32 | LT | 126.5 | 255.8 | 129.3 | 23.4 |
| XA66 | LT | 137.2 | 253.4 | 116.2 | 24.7 |

TABLE 6

| Mechanical Properties at 180 days of Natural Aging | | | | | | |
|---|---|---|---|---|---|---|
| Alloy | Direction | TYS (MPa) | UTS (MPa) | UTS – TYS (MPa) | Total Elong. (%) | n Value (4-6%) |
| XA25 | LT | 145.1 | 273.7 | 128.6 | 19.4 | 0.271 |
| XA26 | LT | 138.9 | 267.2 | 128.2 | 21.9 | 0.271 |
| XA27 | LT | 137.9 | 269.2 | 131.3 | 21.2 | 0.277 |
| XA28 | LT | 146.9 | 281.3 | 134.4 | 22.8 | 0.270 |
| XA29 | LT | 116.2 | 243.7 | 127.6 | 20.9 | 0.299 |
| XA30 | LT | 140.7 | 273.0 | 132.4 | 21.9 | 0.272 |
| XA31 | LT | 119.3 | 244.8 | 125.5 | 19.7 | 0.292 |
| XA32 | LT | 133.1 | 260.6 | 127.6 | 20.3 | 0.278 |
| XA66 | LT | 144.1 | 259.2 | 115.1 | 23.4 | 0.259 |

The paint bake response of the materials was also evaluated. Specifically, at various days of natural aging (as shown in the below tables), specimens of alloys were (i) soaked at 365° F. (185° C.) for 20 minutes (no prestretch) (i.e., "0% PS+365° F./20 min."), or (ii) imparted 2% prestretch and then soaked at 365° F. for 20 minutes (i.e., "200 PS+365° F./20 min."). The same mechanical properties were then measured, the results of which are shown below in Tables 7-11, below.

TABLE 7

| Mechanical Properties at 7 days of Natural Aging plus 0% PS + 365° F./20 min. | | | | | |
|---|---|---|---|---|---|
| Alloy | Direction | TYS (MPa) | UTS (MPa) | UTS – TYS (MPa) | Total Elong. (%) |
| XA25 | LT | 195.8 | 293.7 | 97.9 | 17.2 |
| XA26 | LT | 191.3 | 289.2 | 97.9 | 17.8 |
| XA27 | LT | 199.6 | 295.1 | 95.5 | 16.5 |
| XA28 | LT | 211.0 | 309.2 | 98.2 | 16.9 |
| XA29 | LT | 167.5 | 264.4 | 96.9 | 16.6 |
| XA30 | LT | 198.9 | 297.9 | 98.9 | 17.3 |
| XA31 | LT | 167.5 | 264.8 | 97.2 | 16.9 |
| XA32 | LT | 199.6 | 294.4 | 94.8 | 17.4 |
| XA66 | LT | 216.2 | 297.5 | 81.3 | 18.0 |

TABLE 8

| Mechanical Properties at 90 days of Natural Aging plus 0% PS + 365° F./20 min. | | | | | |
|---|---|---|---|---|---|
| Alloy | Direction | TYS (MPa) | UTS (MPa) | UTS – TYS (MPa) | Total Elong. (%) |
| XA25 | LT | 194.1 | 296.8 | 102.7 | 17.0 |
| XA26 | LT | 183.4 | 292.0 | 108.6 | 19.8 |
| XA27 | LT | 176.9 | 284.8 | 107.9 | 18.7 |
| XA28 | LT | 193.7 | 302.3 | 108.6 | 20.8 |
| XA29 | LT | 148.2 | 257.2 | 108.9 | 18.7 |
| XA30 | LT | 182.7 | 294.1 | 111.4 | 19.4 |
| XA31 | LT | 157.6 | 265.1 | 107.6 | 17.6 |
| XA32 | LT | 182.4 | 286.1 | 103.8 | 17.4 |
| XA66 | LT | 197.2 | 288.6 | 91.4 | 19.7 |

TABLE 9

| Mechanical Properties at 180 days of Natural Aging plus 0% PS + 365° F./20 min. | | | | | |
|---|---|---|---|---|---|
| Alloy | Direction | TYS (MPa) | UTS (MPa) | UTS – TYS (MPa) | Total Elong. (%) |
| XA25 | LT | 191.6 | 291.9 | 100.3 | 15.65 |
| XA26 | LT | 192.4 | 297.5 | 105.1 | 18.9 |
| XA27 | LT | 180.9 | 284.4 | 103.4 | 17.2 |
| XA28 | LT | 199.6 | 305.4 | 105.8 | 17.6 |
| XA29 | LT | 152.7 | 258.6 | 105.8 | 18.3 |
| XA30 | LT | 190.3 | 294.8 | 104.5 | 18.0 |
| XA31 | LT | 161.3 | 267.5 | 106.2 | 17.3 |
| XA32 | LT | 182.7 | 285.8 | 103.1 | 19.3 |
| XA66 | LT | 199.9 | 289.6 | 89.6 | 19.7 |

TABLE 10

| Mechanical Properties at 7 days of Natural Aging plus 2% PS + 365° F./20 min. | | | | | |
|---|---|---|---|---|---|
| Alloy | Direction | TYS (MPa) | UTS (MPa) | UTS – TYS (MPa) | Total Elong. (%) |
| XA25 | LT | 253.4 | 313.4 | 60.0 | 14.1 |
| XA26 | LT | 238.2 | 301.3 | 63.1 | 15.1 |
| XA27 | LT | 247.9 | 309.6 | 61.7 | 15.4 |
| XA28 | LT | 264.1 | 325.4 | 61.4 | 15.6 |
| XA29 | LT | 220.3 | 282.7 | 62.4 | 15.3 |
| XA30 | LT | 248.2 | 313.0 | 64.8 | 16.3 |
| XA31 | LT | 204.8 | 273.0 | 68.3 | 14.0 |
| XA32 | LT | 252.0 | 311.6 | 59.6 | 13.9 |
| XA66 | LT | 251.7 | 308.2 | 56.8 | 14.9 |

TABLE 11

| Mechanical Properties at 30 days of Natural Aging plus 2% PS + 365° F./20 min. | | | | | |
|---|---|---|---|---|---|
| Alloy | Direction | TYS (MPa) | UTS (MPa) | UTS – TYS (MPa) | Total Elong. (%) |
| XA25 | LT | 253.0 | 312.0 | 59.0 | 14.5 |
| XA26 | LT | 241.3 | 305.8 | 64.5 | 14.7 |
| XA27 | LT | 240.6 | 302.7 | 62.1 | 15.5 |
| XA28 | LT | 258.2 | 321.3 | 63.1 | 17.2 |
| XA29 | LT | 215.5 | 279.2 | 63.8 | 14.2 |
| XA30 | LT | 239.3 | 305.1 | 65.9 | 15.2 |
| XA31 | LT | 202.0 | 272.7 | 70.7 | 16.2 |
| XA32 | LT | 242.0 | 304.4 | 62.4 | 15.8 |
| XA66 | LT | 243.0 | 304.1 | 61.0 | 17.5 |

As shown, invention alloys, XA25-XA28, XA30 and XA32 realize tensile properties very close to the control alloy, XA66, despite the fact that the invention alloys contain notably higher iron and/or manganese levels. For instance, as shown in FIGS. 1-2, in the T43 temper and after simulated paint baking with 2% prestretch, the invention alloys realize comparable strength and total elongation to the XA66 baseline alloy, with alloys XA25 and XA28 performing particularly well. Non-invention alloys XA29 and XA31 realize notably lower tensile yield strengths. As also shown, the invention alloy are highly isotropic, realizing low delta r values (e.g., less than 0.20 delta r). The invention alloys are also realize high n (4-6%) values at 180 days of natural aging, indicating the material can elongate further prior to necking, which improves formability.

In addition to ASTM B557 mechanical properties, the VDA bend properties of the materials were also tested, the results of which are shown in Table 12, below. VDA bend tests are conducted in accordance with VDA 238-100. VDA bend tests are used to assess, inter alia, a material's (a) ability to be riveted without cracking and (b) behavior in crash situations. The tests were conducted relative to the transverse orientation (LT), and the reported values are based on the average of four specimens used for each alloy tested. All properties are relative to the LT (long transverse) direction at 30 days of natural aging.

TABLE 12

| VDA Bend properties of Ex. 1 Alloys (30 days of natural aging) | | |
|---|---|---|
| Alloy | Avg Bend Angle α (measured) | TYS (MPa)* |
| XA25 | 114.5 | 130.7 |
| XA26 | 102.0 | 124.1 |
| XA27 | 105.8 | 126.1 |
| XA28 | 116.4 | 134.5 |
| XA29 | 122.7 | 105.2 |
| XA30 | 106.2 | 122.0 |
| XA31 | 113.7 | 108.9 |
| XA32 | 109.0 | 124.8 |
| XA66 | 119.1 | 129.3 |

*The illustrated TYS values are from materials in the T43 temper and from different specimens than those tested above.

As shown (and as illustrated in FIG. 3), the invention alloys realize tensile and bend properties very close to the control alloy, XA66, despite the fact that the invention alloys contain notably higher iron and/or manganese levels. Non-invention alloys XA29 and XA31 realize notably lower strengths. The performance of the invention alloys is surprising because high levels of iron and manganese are known to result in deleterious particles. It is postulated that, by utilizing proper amounts of silicon, magnesium and copper in the base composition, the new 6xxx aluminum alloys described herein may be tolerant of the high iron and/or manganese levels, making the compositions able to utilize high levels of recycled materials in production.

While a number of embodiments of the present invention have been described, it is understood that these embodiments are illustrative only, and not restrictive, and that many modifications may become apparent to those of ordinary skill in the art. Further still, unless the context clearly requires otherwise, the various steps may be carried out in any desired order, and any applicable steps may be added and/or eliminated.

What is claimed is:

1. A 6xxx aluminum alloy sheet product comprising:
0.25-0.60 wt. % Fe;
0.05-0.8 wt. % Mn;
wherein the (wt. % Fe) plus the (wt. % Mn) is at least ≥0.40 wt. %;
0.8-1.2 wt. % Si;
0.55-1.1 wt. % Mg;
wherein the 6xxx aluminum alloy sheet product includes a weight ratio of silicon-to-magnesium in the range of from 0.8:1 to 2.4:1 (Si: Mg);
up to 0.10-0.30 wt. % Cu;
up to 0.50 wt. % Zn;
up to 0.15 wt. % Ti;
up to 0.15 wt. % each of Cr, Zr, and V;
the balance being aluminum, optional incidental elements and impurities;
wherein the 6xxx aluminum alloy sheet product is in a T4 or T43 temper and has a thickness of from 0.5 to 4.0 mm;
wherein the 6xxx aluminum alloy sheet product realizes a TYS (LT) of not greater than 140 MPa at 30 days of natural aging;
wherein the 6xxx aluminum alloy sheet product realizes a (UTS (LT))-(TYS (LT)) of at least 120 MPa at 7 days of natural aging; and
wherein the 6xxx aluminum alloy sheet product is in the form of an automotive component.

2. The 6xxx aluminum alloy sheet product of claim 1, wherein the 6xxx aluminum alloy sheet product includes at least 0.33 wt. % Fe.

3. The 6xxx aluminum alloy sheet product of claim 2, wherein the 6xxx aluminum alloy sheet product includes at least 0.15 wt. % Mn.

4. The 6xxx aluminum alloy sheet product of claim 3, wherein the 6xxx aluminum alloy sheet product includes not greater than 0.25 wt. % Cu.

5. The 6xxx aluminum alloy sheet product of claim 4, wherein the 6xxx aluminum alloy sheet product includes at least 0.05 wt. % of at least one of Cr, V and Zr.

6. The 6xxx aluminum alloy sheet product of claim 5, wherein the 6xxx aluminum alloy sheet product includes at least 0.02 wt. % Ti.

7. The 6xxx aluminum alloy sheet product of claim 1, wherein the (wt. % Fe) plus the (wt. % Mn) is at least ≥0.45 wt. %.

8. The 6xxx aluminum alloy sheet product of claim 1, wherein 6xxx aluminum alloy sheet product realizes a TYS (LT) of not greater than 135 MPa at 7 days of natural aging.

9. The 6xxx aluminum alloy sheet product of claim 1, wherein 6xxx aluminum alloy sheet product realizes a TYS (LT) of not greater than 155 MPa at 180 days of natural aging.

10. The 6xxx aluminum alloy sheet product of claim 1, wherein 6xxx aluminum alloy sheet product realizes a total elongation (LT) of at least 18%.

11. The 6xxx aluminum alloy sheet product of claim 1, wherein 6xxx aluminum alloy sheet product realizes a delta r (Δr) of not greater than 0.20 at 30 days of natural aging.

12. The 6xxx aluminum alloy sheet product of claim 1, wherein 6xxx aluminum alloy sheet product realizes a n (4-6%) value of at least 0.265 in the LT direction at 180 days of natural aging when tested in accordance with ASTM E646.

13. The 6xxx aluminum alloy sheet product of claim 1, wherein the automotive component is an inner door panel or a hood of an automobile.

14. The 6xxx aluminum alloy sheet product of claim 3, wherein the (wt. %Fe) plus the (wt. % Mn) is at least ≥0.55 wt. %.

15. The 6xxx aluminum alloy sheet product of claim 14, wherein the 6xxx aluminum alloy sheet product realizes a (UTS (L))—(TYS (L)) of at least 120 MPa at 7 days of natural aging.

16. The 6xxx aluminum alloy sheet product of claim 3, wherein the (wt. % Fe) plus the (wt. % Mn) is at least ≥0.65 wt. %.

17. The 6xxx aluminum alloy sheet product of claim 3, wherein the 6xxx aluminum alloy sheet product includes not greater than 0.20 wt. % Cu.

* * * * *